US010944212B1

(12) United States Patent
Chen

(10) Patent No.: US 10,944,212 B1
(45) Date of Patent: Mar. 9, 2021

(54) POWER CONNECTOR WITH ANTI-DISENGAGING MECHANISM

(71) Applicant: Liang Light Chen, Los Gatos, CA (US)

(72) Inventor: Liang Light Chen, Los Gatos, CA (US)

( * ) Notice: Subject to any disclaimer, the term of this patent is extended or adjusted under 35 U.S.C. 154(b) by 0 days.

(21) Appl. No.: 16/729,257

(22) Filed: Dec. 27, 2019

(51) Int. Cl.
*H01R 13/639* (2006.01)

(52) U.S. Cl.
CPC ..... *H01R 13/639* (2013.01)

(58) Field of Classification Search
CPC .... H01R 13/639; H01R 13/625; H01R 13/44; H01R 13/62; H01R 13/02
USPC ..... 439/312
See application file for complete search history.

(56) References Cited

U.S. PATENT DOCUMENTS 3,710,304 A * 1/1973 Warner ..... H01R 13/193 439/346
3,942,856 A * 3/1976 Mindheim ..... H01R 13/707 200/51.09
4,061,409 A * 12/1977 Bealmear ..... H01R 13/20 439/346
4,345,122 A * 8/1982 Janniello ..... H01R 13/707 200/50.29
4,822,290 A * 4/1989 Cauley ..... H01R 13/4534 439/137
4,846,707 A * 7/1989 Pirkle ..... H01R 13/44 439/142
4,925,396 A * 5/1990 Grover ..... H01R 13/639 439/147
4,971,571 A * 11/1990 Puerner ..... H01R 13/627 439/346
4,978,315 A * 12/1990 Edgley ..... H01R 4/4827 439/441
5,082,450 A * 1/1992 Warren, Sr. ..... H01R 13/6395 439/102
5,316,493 A * 5/1994 Sowers ..... H01R 13/443 439/148
5,336,103 A * 8/1994 Herboldsheimer .. H01R 13/193 439/265
5,551,884 A * 9/1996 Burkhart, Sr. ..... H01R 13/20 439/140
5,692,921 A * 12/1997 Jennings ..... H01R 13/20 439/173

(Continued)

*Primary Examiner* — Alexander Gilman
(74) *Attorney, Agent, or Firm* — Douglas L. Weller

(57) ABSTRACT

A power connector with an anti-disengaging mechanism that has a power socket that includes a metal terminal. The power socket is shaped to receive a plug pin of a power plug. A seizing piece that includes a through hole. The seizing piece is located so that the plug pin of the power plug travels through the through hole in order to come in contact with the metal terminal. A pull rod is arranged so that when the pull rod is in a first position, the pull rod tilts the seizing piece so as to lock the plug pin in contact with the metal terminal. When the pull rod is in a second position, the seizing piece releases the plug pin. A toggle ring is rotated by a user to drive the pull rod to slide between the first position and the second position. A first portion of the seizing piece is within a supporting groove inside the power connector. A second portion of the seizing piece is inserted into a driving groove of the pull rod. Movement of the pull rod is controlled by the toggle ring.

18 Claims, 9 Drawing Sheets

(56) References Cited

U.S. PATENT DOCUMENTS

| | | | | | |
|---|---|---|---|---|---|
| 5,893,772 | A * | 4/1999 | Carmo | H01R 13/639 | 439/346 |
| 6,171,129 | B1 * | 1/2001 | Phillips | H01R 13/193 | 439/263 |
| 6,193,539 | B1 * | 2/2001 | Chang | H01R 13/6278 | 439/346 |
| 6,234,823 | B1 * | 5/2001 | Fuess | H01R 13/5816 | 439/346 |
| 6,315,593 | B1 * | 11/2001 | Bentley | H01R 13/20 | 439/346 |
| 6,575,759 | B1 * | 6/2003 | Ollivier | A61N 1/3752 | 439/2 |
| 6,652,307 | B2 * | 11/2003 | Tatz | H01R 13/6397 | 439/134 |
| 7,041,918 | B1 * | 5/2006 | Wu | H01R 13/703 | 200/51.09 |
| 7,080,889 | B2 * | 7/2006 | Ling | H01R 13/6397 | 200/334 |
| 7,361,045 | B1 * | 4/2008 | Vinciguerra | H01R 13/20 | 439/346 |
| 8,123,546 | B2 * | 2/2012 | Suzuki | H01R 13/62 | 439/372 |
| 8,439,697 | B2 * | 5/2013 | Vass | H01R 13/652 | 439/346 |
| 9,407,041 | B2 * | 8/2016 | Lirong | H01R 13/6392 | |
| 2003/0207606 | A1 * | 11/2003 | Ho | H01R 13/20 | 439/346 |
| 2005/0101169 | A1 * | 5/2005 | Ratcliffe | H01R 13/639 | 439/106 |
| 2009/0061667 | A1 * | 3/2009 | Grieff | H01R 31/06 | 439/151 |
| 2010/0144187 | A1 * | 6/2010 | Chapel | H01R 43/26 | 439/357 |

* cited by examiner

POWER CONNECTOR WITH ANTI-DISENGAGING MECHANISM

BACKGROUND OF THE INVENTION

A power plug is a power transfer device that connects electric equipment to a power source. A sudden outage can cause serious loss of life and property when power is supplied to important equipment such as a data center requiring continuous power supply, a medical apparatus or instruments in an operating room, etc. Therefore, there is a need for a safe, reliable, simple and effective power source connection. If a power plug loosens or drops out when shaken or collided by external force, this will lead to poor contact or no contact and result in a power outage.

DETAILED DESCRIPTION

Figure 1:
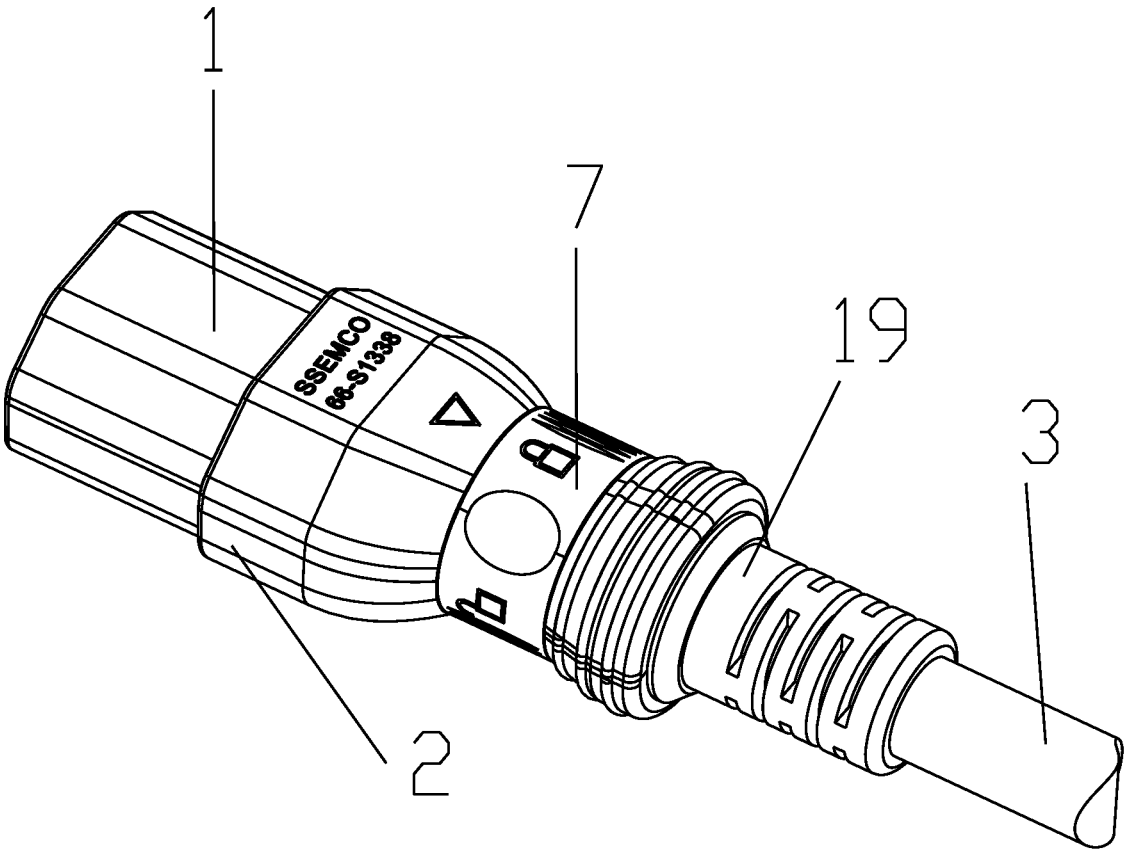
FIG. 1 is a perspective view of A power connector with an anti-disengaging mechanism in accordance with an implementation.

In view of the above problems, an anti-disengaging mechanism for a power connector is described below. The anti-disengaging mechanism improves the connection between the power plug and the input end of a device, so as to ensure the continuous power supply for a device and to avoid an accidental power failure.

The anti-disengaging mechanism includes an upper box body, a lower box body and an electric wire provided between the upper and lower box bodies. A first end of the electric wire extends from the upper box body and the lower box body, and a second end of the electric wire is connected to a metal terminal. Between the upper box body and the lower box body, there is a swingable seizing piece for engaging a plug pin of a power plug. The seizing piece is swung by a pull rod, and the pull rod is driven to move along the length of the pull rod by a toggle ring provided on the upper box body and the lower box body.

For example, a protrusion button is provided on a first end surface of the pull rod. An inner wall surface of the toggle ring is provided with a chute for driving the movement of the protrusion button. In addition, a second end of the pull rod is provided with a recessed slot for limiting the seizing piece.

For example, an outer cover of the electric wire is provided with a wire fixing cover. A lower part of the outer surface of the wire fixing cover is provided with an outer buckle. The outer buckle has a limit fit with a slot on the lower box body. In addition, an upper part of the wire fixing cover of the electric wire is provided with a U-shaped guide slot at the first end of a guide rod.

For example, when the upper box body and the lower box body are closed, the first end portion forms a cylindrical annular sleeve and a conical annular sleeve. The toggle ring is sleeved over a periphery of the cylindrical annular sleeve. The cylindrical annular sleeve is provided with a through hole for the protrusion button to pass through. The conical annular sleeve is provided with a rectangular limiting slot for limiting an electric wire connector.

For example, the seizing piece is disposed on a side portion of the upper and lower box body, and this side is provided with a limiting slot for limiting the seizing piece from swinging.

Further, the toggle ring has two halves, which are, respectively, a first half and a second half. A protrusion post and a recessive hole matched with the protrusion post are provided on the opposite faces of the two halves, the chute mentioned previously is provided on the inner wall surface of the first half, and the chute is arranged along the circumferential direction of the inner wall surface of the first half, it has a drop in the axial direction. The inner wall surface of the second half body is densely covered by a tooth slot, and the cylindrical annular sleeve is provided with an elastic piece matching the tooth slot to increase the toggle ring resistance.

For example, the slot depth at the head end and the tail end of the above-mentioned tooth slot is deeper than the slot depth at other locations. The outer buckle 12 cooperates with the slot 13 on lower box body 2 for position limiting. The upper part of the electric wire fixing cover 11 is provided with a U-shaped guide slot 14 to guide a first end of the pull rod 6. The outer buckle 12 is buckled in the slot 13 on the lower box body, so that the three core of the electric wire can be stably positioned therein, so as to avoid an accidental movement of the three core wires, which may affect the movement of the pull rod. The U-shaped guide slot 14 is also beneficial for making the pull rod move along a fixed track, so as to ensure the accuracy of locking and unlocking actions.

For example, the seizing piece is a manganese steel piece. In addition, a center of the seizing piece has a through hole, the plug pin of a power plug passes through the through hole; the through hole is slightly larger than the plug pin of the power plug. Moreover, the side portion of the seizing piece has a protrusion portion within a recessed slot.

The working method of the anti-disengaging mechanism for a cable structure provided in the present invention is characterized in that: the anti-disengaging mechanism includes an upper box body, a lower box body and an electric wire provided between the upper and lower box bodies. A first end of the electric wire extends from the upper box body and the lower box body, and a second end of the electric wire is connected to a metal terminal. Between the upper box body and the lower box body, there is a swingable seizing piece for engaging a plug pin of a power plug, and the seizing piece is swung by a pull rod, and the pull rod is driven to move along the length of the pull rod by a toggle ring provided on the upper box body and the lower box body. During work, by way of turning the toggle ring on the upper and lower box bodies, this makes the toggle ring drive the pull rod to move along the length of the pull rod. The front end of the pull rod drives the seizing piece to rotate, accordingly the front end of the lever drives the seizing piece to rotate, which misaligns the seizing piece with the plug pin of the power plug. The seizing piece engages the plug pin of the power plug, such that it difficult to pull it out from the socket. When the power plug needs to be pulled out from the socket, the toggle ring is turned in the opposite direction, which drives the pull rod along the length of the pull rod. The front end of the pull rod drives the seizing piece to straighten. As a result, the front end of the pull rod drives the seizing piece to be in a position in which the seizing piece is perpendicular to the plug pin of the power plug. In this way, the seizing piece does not seize against the plug pin of the power plug, which allows the power plug to be easily pulled out from the socket.

For example, the seizing piece is a manganese steel piece. In addition, a center of the seizing piece has a through hole, the plug pin of a power plug passes through the through hole; the through hole is slightly larger than the plug pin of the power plug. Moreover, the side portion of the seizing piece has a protrusion portion within a recessed slot. When the seizing piece and the socket metal contact are misaligned, the inner wall surface of the through hole of the seizing piece is seized by a side surface of the plug pin of the power plug, which result in an increase in the resistance against the relative movement of the two components. As a result, it is difficult to pull out the power plug from the socket.

The anti-disengaging mechanism can realize the function of locking or releasing the power plug with a power socket by rotating a toggle ring. It is easy to operate. In a locked state, it can improve the security of the connection between the power plug and the power socket, so as to avoid an accidental power failure.

Reference is now made to the embodiments shown in the Figures. FIG. 1 shows a power connector that has an anti-disengaging mechanism. The power connector has an upper box body 1, a lower box body 2 and an electric cord 3 provided between the upper and lower box bodies. A first end of the electric cord 3 extends from the upper lower box body 1 and the lower box body 2. Also shown in FIG. 1 are a wire strain relief 19 and a toggle ring 7. The upper box body 1 and the lower box body 2 may be snap-fastened, screwed or welded together.

Figure 2:
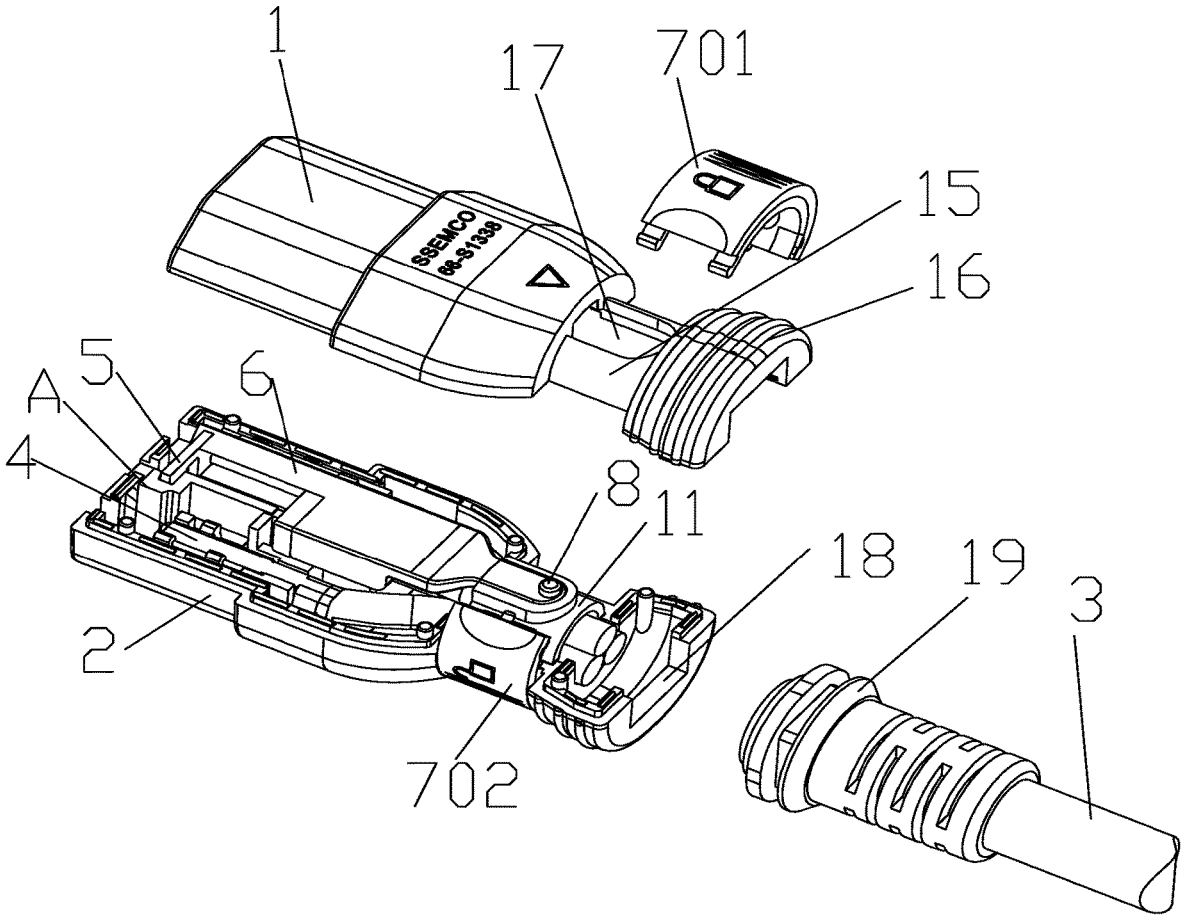
FIG. 2 is an exploded view of the power connector shown in FIG. 1, in accordance with an implementation.
Figure 3:
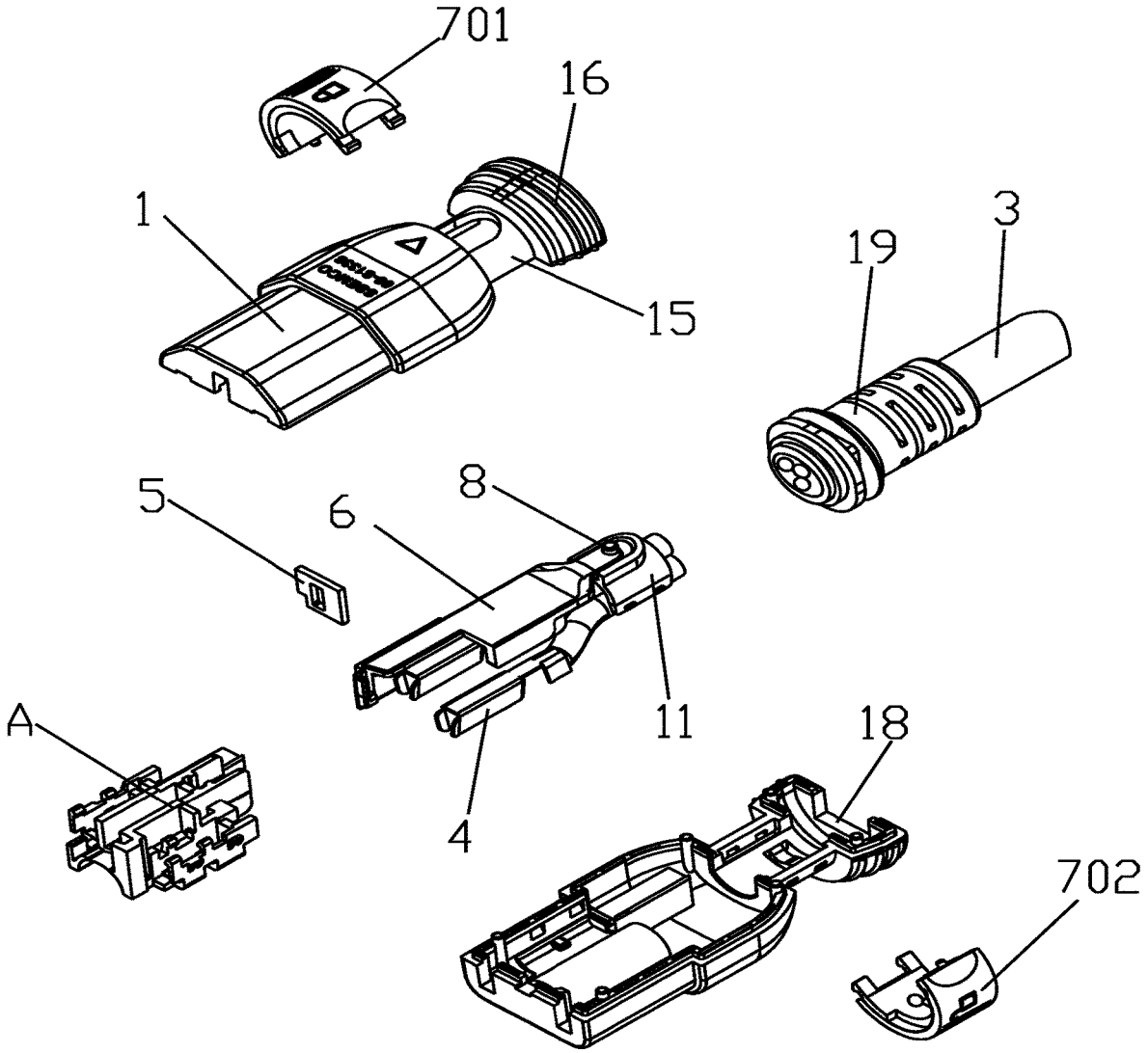
FIG. 3 is an exploded view of the power connector shown in FIG. 1, in accordance with an implementation

FIG. 2 and FIG. 3 show that between upper box body 1 and lower box body 2, there is a swingable seizing piece 5 for engaging a plug pin of a power plug, and the seizing piece 5 is swung by a pull rod 6. Pull rod 6 is driven to move along the length of the pull rod by toggle ring 7 provided on upper box body 1 and lower box body 2.

For example, electric cord 3 is a three-core electric that has three electric wires. Each of the electric wires of electric cord 3 is connected to a metal terminal. Metal terminal 4 is shown within a power socket of the power connector. Metal terminal 4 is mounted on a core frame A of the upper box body 1 and the lower box body 2. Metal terminal 4 is the metal contact of the power socket. A metal plug pin of a three-core socket enters into a socket and comes in contact with metal terminal 4 of the power socket. For example, the cross-section of metal terminal 4 is in a rectangular shape.

In order to enable toggle ring 7 to drive the pull rod 6 to move along the length of the pull rod, the first end surface of the pull rod 6 is provided with a protrusion button 8. In order to prevent the wires from affecting the operation of the pull rod 6, the outer cover of the wires is provided with a wire fixing cover 11.

In order to facilitate toggle ring 7 to drive the pull rod 6, when upper box body 1 and lower box body 2 are closed, the first end portion forms a cylindrical annular sleeve 15 and a conical annular sleeve 16. Toggle ring 7 is sleeved over the periphery of the cylindrical annular sleeve 15. The cylindrical annular sleeve 15 is provided with a through hole 17 for the protrusion button 8 to pass through. The conical annular sleeve 16 is provided with a rectangular limiting slot 18 for limiting the wire strain relief 19. The rectangular limiting slot 18 can better limit the wire strain relief 19. The inner hole channel of the wire strain relief 19 holds the wire.

For example, for convenient installation, the above-mentioned toggle ring 7 includes two halves, namely a first half body 701 and a second half body 702. The first half body 701 and the second half body 702 are connected to the slot by a snap, by screws or by welding.

Figure 4:
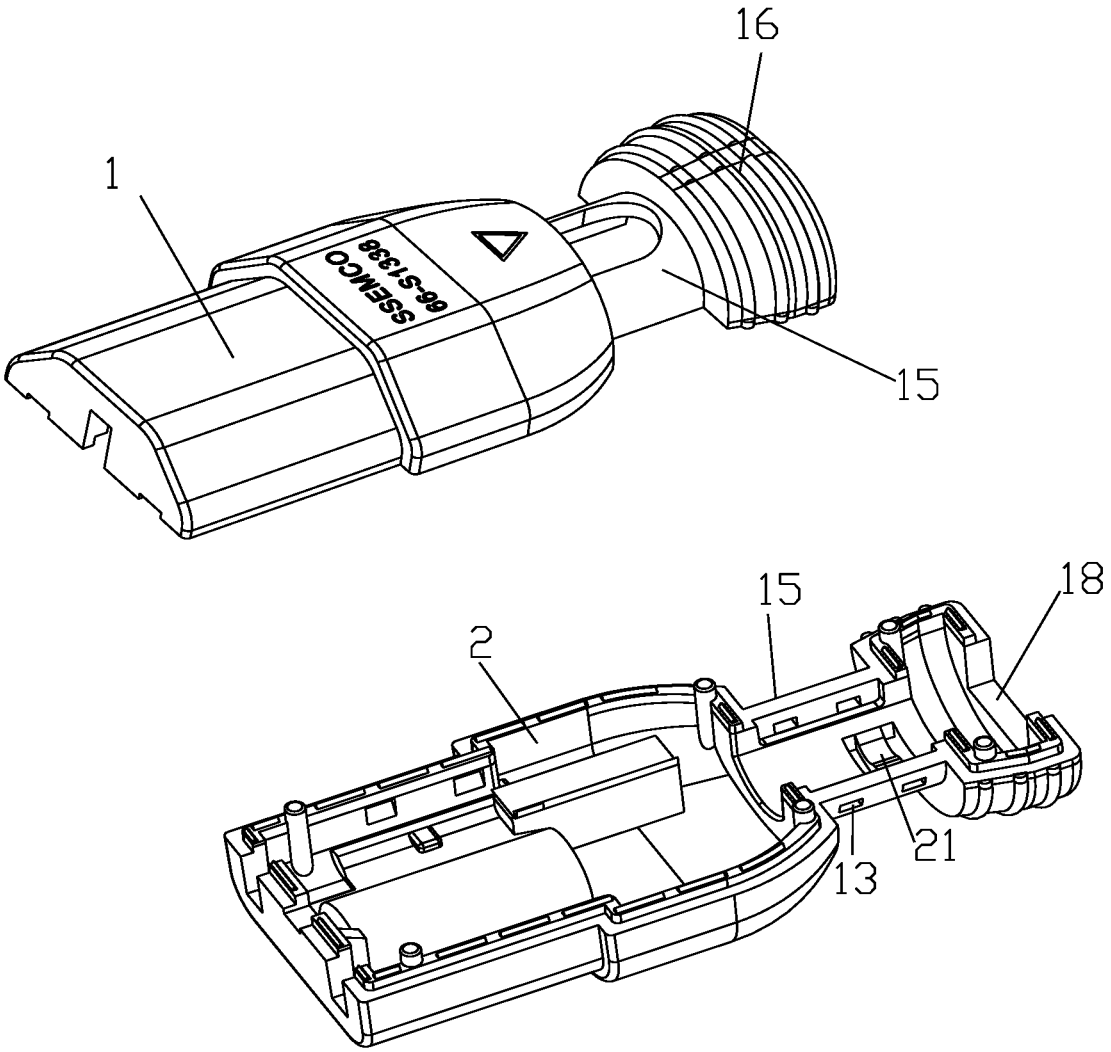
FIG. 4 is a perspective view of upper housing structure and lower housing structure in a disassembled state in accordance with an implementation.
Figure 5:
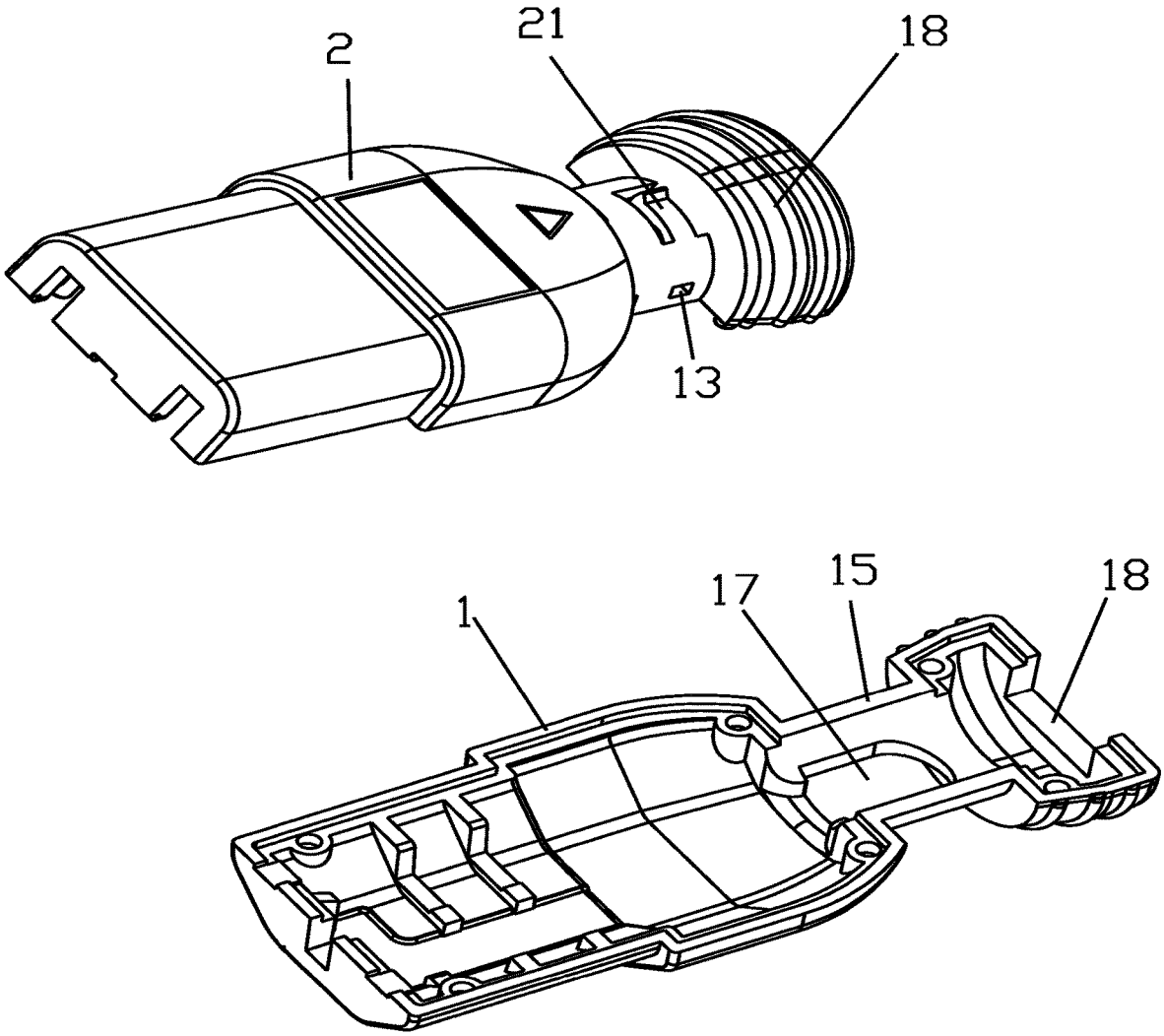
FIG. 5 is another perspective view of upper housing structure 1 and lower housing structure 2 in an exploded state in accordance with an implementation.

FIG. 4 and FIG. 5 show that lower box body 2 has a slot 13 and an elastic piece 21.

Figure 6:
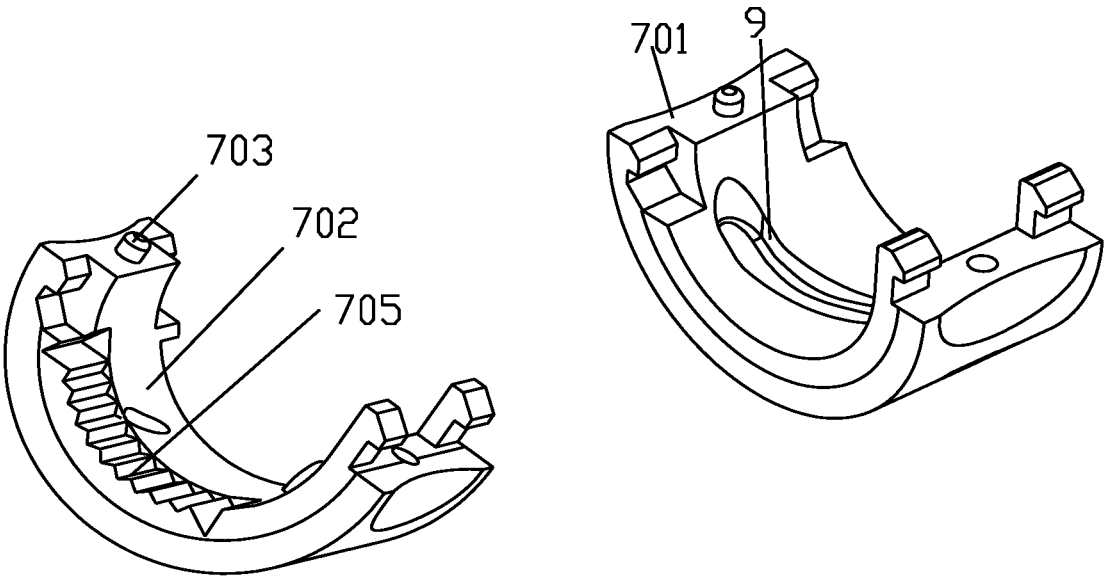
FIG. 6 is perspective view of a toggle ring in an exploded state in accordance with an implementation.
Figure 7:
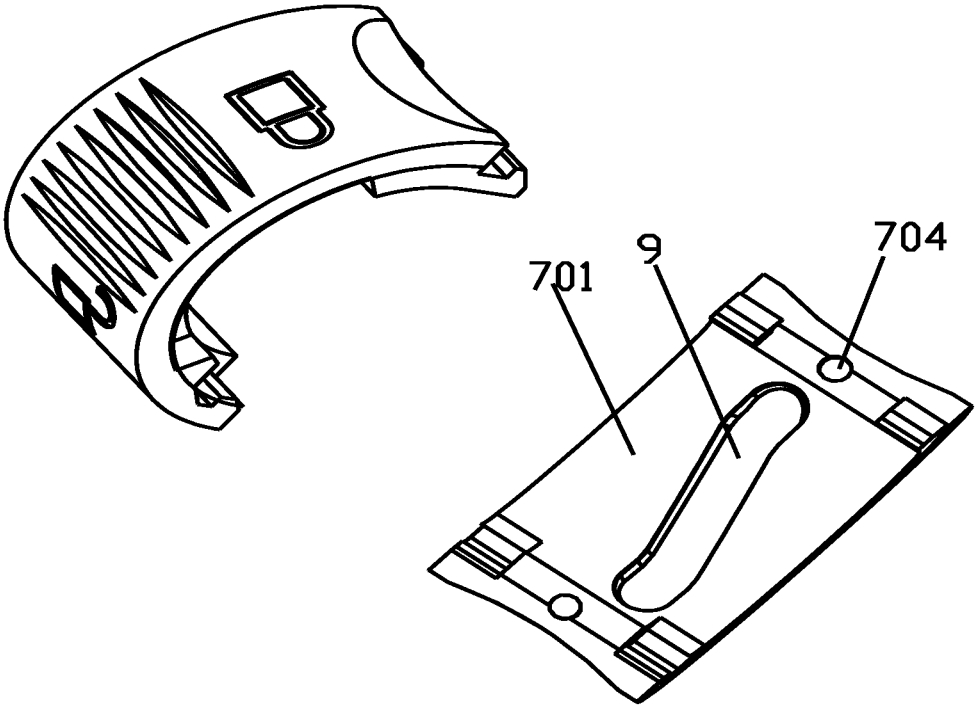
FIG. 7 is another perspective view of a toggle ring in an exploded state in accordance with an implementation.

FIG. 6 and FIG. 7 show that a protrusion post 703 and a recessive hole 704 matching the protrusion post are provided on the opposite sides of first half body 701 and second half body 702. The protrusion post 703 and the recessive hole 704 can achieve better positioning. The inner wall surface of the first half is provided with the chute 9. Chute 9 is used for driving the protrusion toggle ring 8 to move. The chute 9 is arranged circumferentially along the inner wall surface of the first half body 701 and has a drop in the axial direction. The value of the axial drop value is equal to the moving distance of the pull rod 6. The inner wall surface of the second half body 702 is densely covered with a tooth slot 705.

Elastic piece 21 of cylindrical annular sleeve 15 cooperates with the tooth slot 705 to increase the resistance of toggle ring 7, thereby avoiding unintentional movement of toggle ring 7. The elastic piece 21 can be slightly locked in the tooth slot 705, and a certain rotational force thus is required to turn toggle ring 7. In this way, it can prevent it from being turned by a child. In order to make the two limiting positions (locked and unlocked positions) easily visible, so that people can easily recognize the positions, the slot depth at the head end and the tail end of the slot is deeper than the depth thereof in the middle position. The slot depth at these two positions can be 1.5 to 2 times the depth of the middle section. The groove depth at the head end and the tail end of the tooth slot is deeper than the groove depth in a middle position, which not only facilitates people to recognize the locking and unlocking positions, but also avoids the possibility that it may be turned by a child by accident. An elastic piece 21 is provided as follows: the cylindrical annular sleeve 15 is provided with a through slot, and an elastic arm is suspended on a side wall of the through slot. A free end of the elastic arm is provided with a protrusion key protruding into the tooth slot 705.

Figure 8:
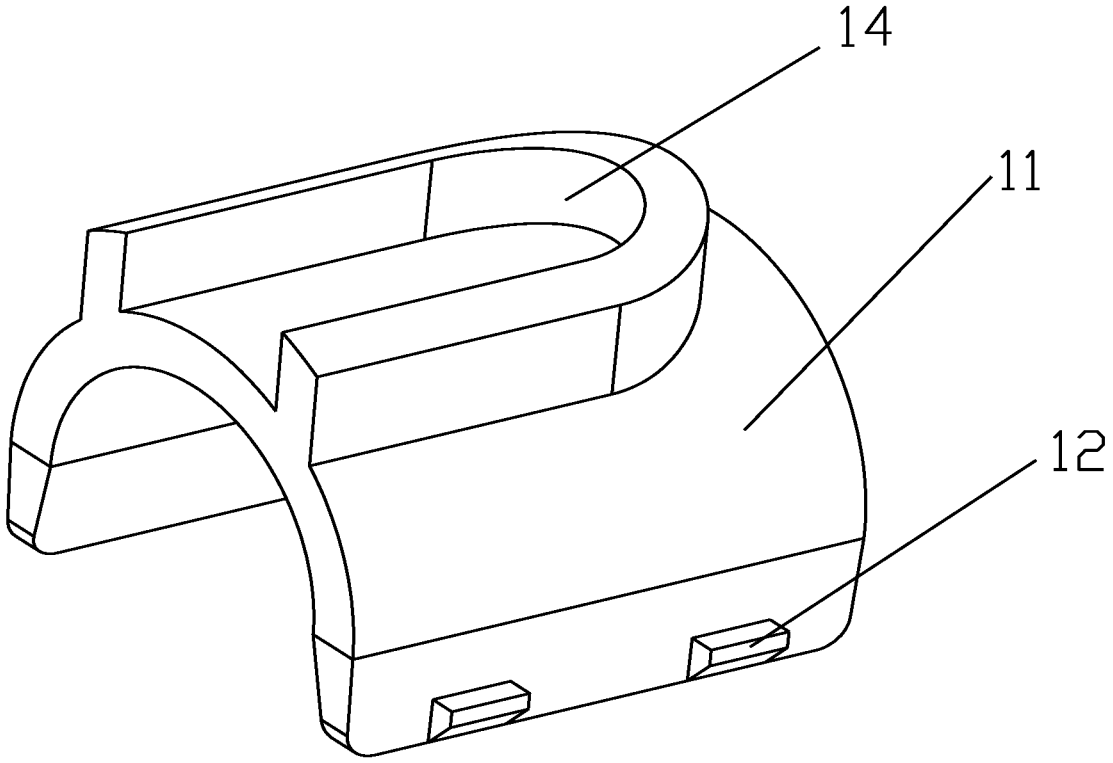
FIG. 8 is a perspective view of an electric wire fixing cover in accordance with an implementation.

FIG. 8 shows that the lower part of the outer surface of electric wire fixing cover 11 is provided with an outer buckle 12. The outer buckle 12 cooperates with the slot 13 (shown In FIG. 5) on lower box body 2 for position limiting. The upper part of the electric wire fixing cover 11 is provided with a U-shaped guide slot 14 to guide a first end of the pull rod 6. The outer buckle 12 is buckled in the slot 13 on the lower box body, so that the three core of the electric wire can be stably positioned therein, so as to avoid an accidental movement of the three core wires, which may affect the movement of the pull rod. The U-shaped guide slot 14 is also beneficial for making the pull rod move along a fixed track, so as to ensure the accuracy of locking and unlocking actions.

Figure 9:
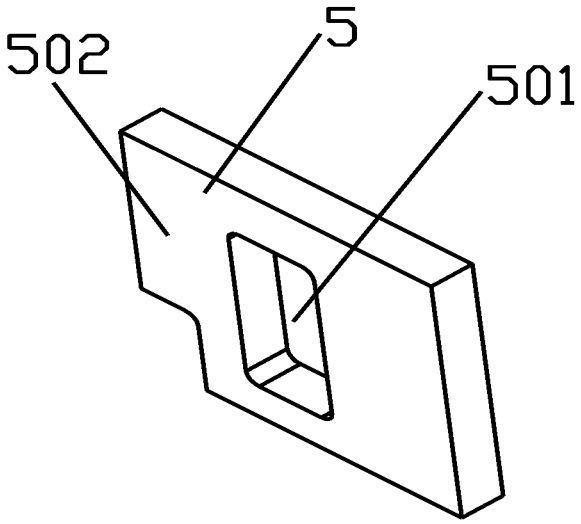
FIG. 9 is a perspective view of a seizing piece in accordance with an implementation.

FIG. 9 shows that seizing piece 5 includes a through hole 501. For example, in order to better lock the plug pin of the power plug to achieve a secure locking effect, seizing piece 5 is a manganese steel piece. The size of the center through hole 501 for the plug pin of the power plug to pass therethrough is slightly larger than that of the plug pin of the power plug. For example, one side of seizing piece 5 has an optional protrusion portion 502 that is within the recessed slot. When seizing piece 5 is made by a manganese steel sheet, its strength and rigidity are good, which makes it difficult to deform when in contact with the plug pin of the power plug, and the resistance to pull out is therefore considerably large. In addition to the limiting effect from the recessed slot, upper box body 1 and lower box body 2 are also provided with limit slots to limit its movement in the up and down, and back and forth directions. Except for the seizing piece 5, the metal terminal 4 and the core wire, the other connecting members in this application are made, for example, of plastic.

For example, the size of a through hole 501 of the seizing piece 5 is slightly larger than that of the plug pin of the power plug. When the plug pin of the power plug is perpendicular to the seizing piece 5, the plug pin of the power plug can move smoothly within the through hole 501 on the seizing piece 5; while when the seizing piece 5 is tilted (also referred to as misaligned) as driven by the pull rod 6, the inner wall surface of the through hole 501 presses against the surface of the plug pin of the power plug, at the same time, the pull rod and toggle ring cannot easily reset when they are in a locked state. In this way, the seizing piece 5 is maintained in a state where it is tilted against the plug pin of the power plug, which helps the power plug and the socket remain in a state of tight connection.

Figure 10:
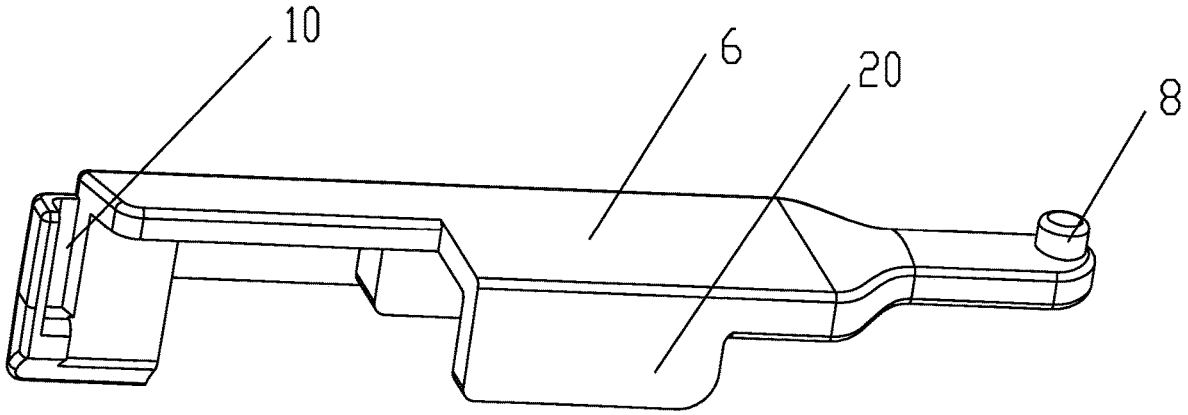
FIG. 10 and FIG. 11 show perspective views of a pull rod in accordance with an implementation.
Figure 11:
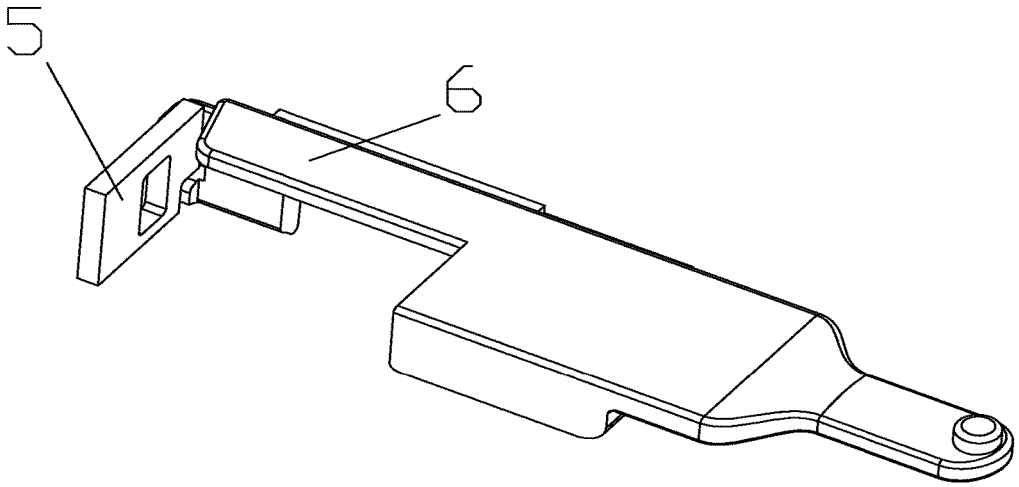

FIG. 10 and FIG. 11 show an implementation where in order to have a stable movement of pull rod 6, two sides of pull rod 6 are provided with limit plate bodies 20 for limiting the left and right swing of pull rod 6. For example, the second end of the pull rod 6 is provided with a recessed slot 10 for limiting the seizing piece 5. For example, the recessed slot 10 may be a slot body on the side of the pull rods 6 as shown in FIG. 10.

Figure 12:
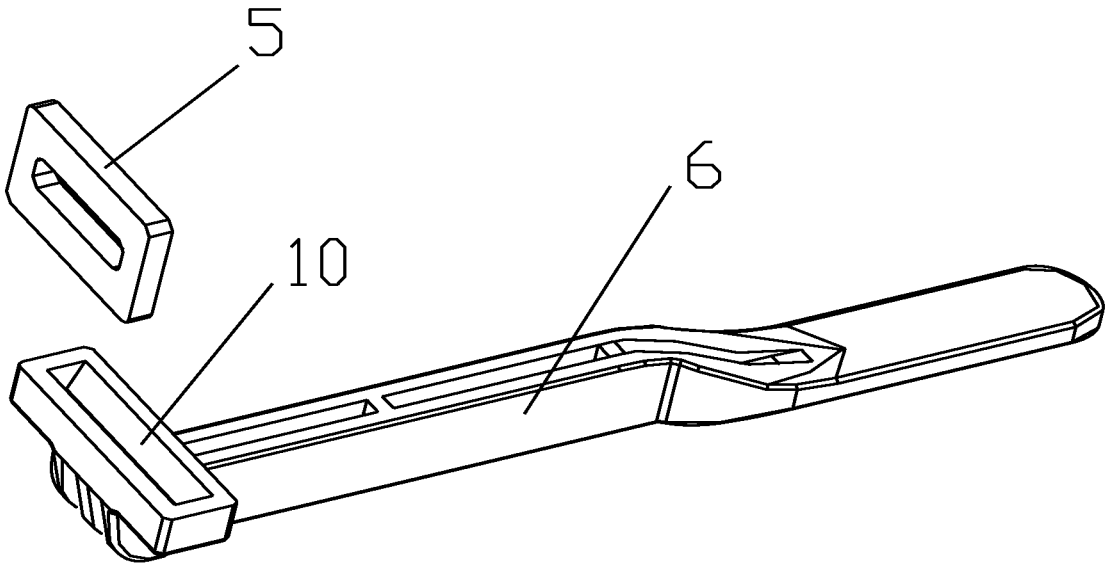
FIG. 12 and FIG. 13 are perspective exploded views of a pull rod and a seizing plate according to another implementation.
Figure 13:
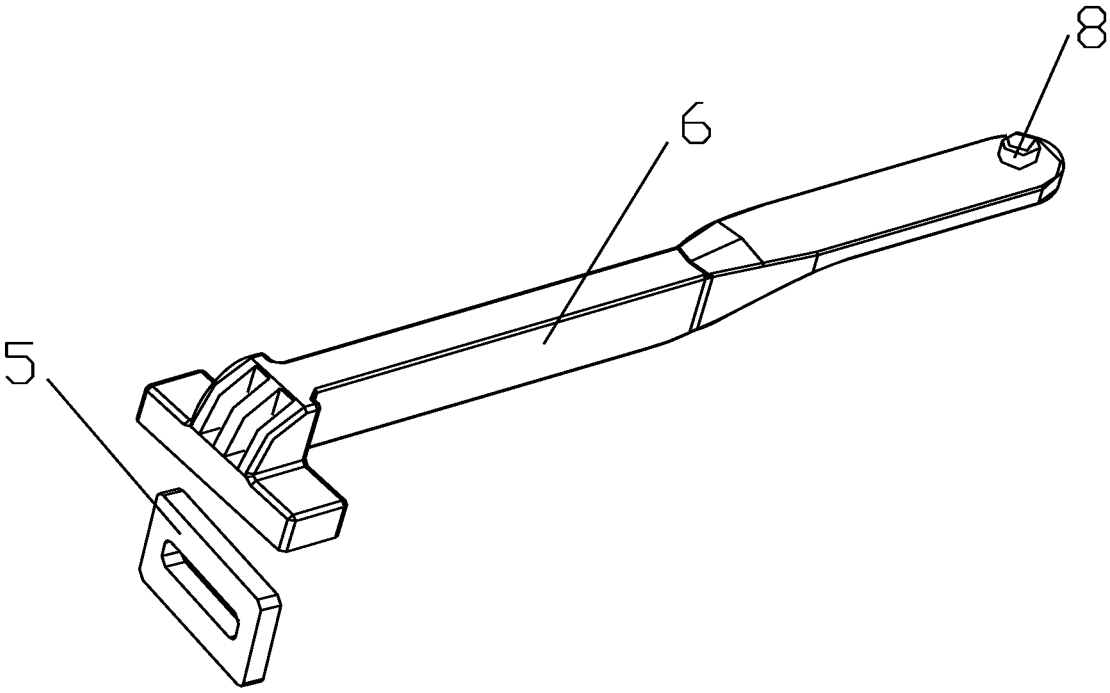

However, in another embodiment shown in FIG. 12 and FIG. 13, pull rod 6 does not include such a limit plate body. The result is that seizing piece 5 swing directions in the embodiment shown in FIG. 12 and FIG. 13 is different than seizing piece 5 swing directions in the embodiment shown in FIG. 10 and FIG. 1.

Specifically, in the embodiment shown in FIGS. 12 and 13 an inner slot body located is at the end of the pull rod 6. Although the shapes or structures of the two types of pull rods 6 shown in the two above embodiments of pull rod 6 are not quite the same, in each embodiment, pull rod 6 works to pull seizing piece 5 through the recessed slot by the pull rod. The chute 9 is arranged circumferentially along the inner wall surface of a first half body 701 and has a drop in the axial direction. The chute 9 has three sections, the lengths of the front and rear sections are relatively short and parallel to a normal plane of an axis of toggle ring 7. The middle section is relatively long and forms an angle with the normal plane of the axis of toggle ring 7. The distance between the front and rear sections of the chute 9 is equal to the distance in which the pull rod 6 moves along its length. The positions of the protrusion button 8 in the front and rear sections of the chute 9 are respectively the locked position and unlocked position.

The working method of the anti-disengaging mechanism provided in the above described embodiments is as follows: the power connector with the anti-disengaging mechanism includes an upper box body 1, a lower box body 2 and an electric cord provided between the upper and lower box bodies. A first end of the electric wire extends from upper box body 1 and lower box body 2, and a second end of the electric cord has electric wires, each wire connected to a metal terminal. Between upper box body 1 and lower box body 2, there is a swingable seizing piece for engaging a plug pin of a power plug, and seizing piece 5 is swung by a pull rod 6, and pull rod 6 is driven to move along the length of pull rod 6 by a toggle ring provided on upper box body 1 and lower box body 2. During work, by way of turning toggle ring 7 on the upper and lower box bodies, this makes toggle ring 7 drive pull rod 6 to move along the length of pull rod 6. The front end of pull rod 6 drives seizing piece 5 to rotate, accordingly the front end of the lever drives seizing piece 5 to rotate, which misalign seizing piece 5 with the plug pin of the power plug. Seizing piece 5 engages the plug pin of the power plug, such that it difficult to pull it out from the socket. When the power plug needs to be pulled out from the socket, toggle ring 7 is turned in the opposite direction, which drives pull rod 6 along the length of pull rod 6. The front end of pull rod 6 drives seizing piece 5 to straighten. As a result, the front end of pull rod 6 drives seizing piece 5 to be in a position in which seizing piece 5 is perpendicular to the plug pin of the power plug. In this way, seizing piece 5 does not seize against the plug pin of the power plug, which allows the power plug to be easily pulled out from the socket.

For example, seizing piece 5 is a manganese steel piece. In addition, a center of seizing piece 5 has a through hole 501, the plug pin of a power plug passes through the through hole 501; through hole 501 is slightly larger than the plug pin of the power plug. Moreover, the side portion of seizing piece 5 has a protrusion portion within a recessed slot. When seizing piece 5 and the socket metal contact are misaligned, the inner wall surface of through hole 501 of seizing piece 5 is seized by a side surface of the plug pin of the power plug, which result in an increase in the resistance against the relative movement of the two components. As a result, it is difficult to pull out the power plug from the socket.

The anti-disengaging mechanism can realize the function of locking or releasing the power plug with a power socket by rotating toggle ring 7. It is easy to operate. In a locked state, it can improve the security of the connection between the power plug and the power socket, so as to avoid an accidental power failure.

Finally, it should be noted that the above embodiments are only used to illustrate the technical solution rather than limit it. Although the present invention has been described in detail with reference to the preferred embodiments, a person skilled in the art will understand that modifications to specific embodiments or equivalent replacement of some technical features can still be made without departing from the spirit of the technical solution. Hence, all of these changes should be covered within the scope of the technical solution set forth in the present invention.

The invention claimed is:

1. A power connector with an anti-disengaging mechanism, comprising:

a power socket that includes a metal terminal, the power socket being shaped to receive a plug pin of a power plug;

a seizing piece, the seizing piece including a through hole, the seizing piece being located so that the plug pin of the power plug travels through the through hole in order to come in contact with the metal terminal;

a pull rod arranged so that when the pull rod is in a first position, the pull rod tilts the seizing piece so as to lock the plug pin in contact with the metal terminal and when the pull rod is in a second position, the seizing piece releases the plug pin;

a toggle ring that is rotated by a user to drive the pull rod to slide between the first position and the second position; and, wherein a first portion of the seizing piece is within a supporting groove inside the power connector, while a second portion of the seizing piece is inserted into a driving groove of the pull rod, movement of the pull rod being controlled by the toggle ring;

wherein the toggle ring includes a chute with an axial drop that is equal to a moving distance of the pull rod;

wherein the pull rod includes a protrusion button that is placed within the chute so that rotation of the toggle ring moves the pull rod from the first position to the second position.

2. The power connector according to claim 1, wherein the chute is an arc-shaped groove that inclines to a longitudinal direction.

3. The power connector according to claim 2, wherein two sides of the pull rod are provided with limit plate bodies for limiting the left and right swing of the pull rod.

4. The power connector according to claim 3, wherein an inner slot body is located at an end of the pull rod.

5. The power connector according to claim 4:

wherein the toggle ring includes a tooth slot; and wherein the power connector additionally includes an elastic piece slightly locked in the tooth slot so as to increase rotational force required to rotate the toggle ring.

6. The power connector according to claim 2, wherein an inner slot body is located at an end of the pull rod.

7. The power connector according to claim 6:

wherein the toggle ring includes a tooth slot; and wherein the power connector additionally includes an elastic piece slightly locked in the tooth slot so as to increase rotational force required to rotate the toggle ring.

8. The power connector according to claim 2:

wherein the toggle ring includes a tooth slot; and wherein the power connector additionally includes an elastic piece slightly locked in the tooth slot so as to increase rotational force required to rotate the toggle ring.

9. The power connector according to claim 1, wherein two sides of the pull rod are provided with limit plate bodies for limiting the left and right swing of the pull rod.

10. The power connector according to claim 9, wherein an inner slot body is located at an end of the pull rod.

11. The power connector according to claim 10:

wherein the toggle ring includes a tooth slot; and wherein the power connector additionally includes an elastic piece slightly locked in the tooth slot so as to increase rotational force required to rotate the toggle ring.

12. The power connector according to claim 9:

wherein the toggle ring includes a tooth slot; and wherein the power connector additionally includes an elastic piece slightly locked in the tooth slot so as to increase rotational force required to rotate the toggle ring.

13. The power connector according to claim 1, wherein an inner slot body is located at an end of the pull rod.

14. The power connector according to claim 13:

wherein the toggle ring includes a tooth slot; and wherein the power connector additionally includes an elastic piece slightly locked in the tooth slot so as to increase rotational force required to rotate the toggle ring.

15. The power connector according to claim 1:

wherein the toggle ring includes a tooth slot; and wherein the power connector additionally includes an elastic piece slightly locked in the tooth slot so as to increase rotational force required to rotate the toggle ring.

16. A power connector with an anti-disengaging mechanism, comprising:

a power socket that includes a metal terminal, the power socket being shaped to receive a plug pin of a power plug;

a seizing piece, the seizing piece including a through hole, the seizing piece being located so that the plug pin of the power plug travels through the through hole in order to come in contact with the metal terminal;

a pull rod arranged so that when the pull rod is in a first position, the pull rod tilts the seizing piece so as to lock the plug pin in contact with the metal terminal and when the pull rod is in a second position, the seizing piece releases the plug pin;

a toggle ring that is rotated by a user to drive the pull rod to slide between the first position and the second position; and, wherein a first portion of the seizing piece is within a supporting groove inside the power connector, while a second portion of the seizing piece is inserted into a driving groove of the pull rod, movement of the pull rod being controlled by the toggle ring;

wherein two sides of the pull rod are provided with limit plate bodies for limiting the left and right swing of the pull rod.

17. A power connector with an anti-disengaging mechanism, comprising:

a power socket that includes a metal terminal, the power socket being shaped to receive a plug pin of a power plug;

a seizing piece, the seizing piece including a through hole, the seizing piece being located so that the plug pin of the power plug travels through the through hole in order to come in contact with the metal terminal;

a pull rod arranged so that when the pull rod is in a first position, the pull rod tilts the seizing piece so as to lock the plug pin in contact with the metal terminal and when the pull rod is in a second position, the seizing piece releases the plug pin;

a toggle ring that is rotated by a user to drive the pull rod to slide between the first position and the second position; and, wherein a first portion of the seizing piece is within a supporting groove inside the power connector, while a second portion of the seizing piece is inserted into a driving groove of the pull rod, movement of the pull rod being controlled by the toggle ring;

wherein an inner slot body is located at an end of the pull rod.

18. A power connector with an anti-disengaging mechanism, comprising:

a power socket that includes a metal terminal, the power socket being shaped to receive a plug pin of a power plug;

a seizing piece, the seizing piece including a through hole, the seizing piece being located so that the plug pin of the power plug travels through the through hole in order to come in contact with the metal terminal;

a pull rod arranged so that when the pull rod is in a first position, the pull rod tilts the seizing piece so as to lock the plug pin in contact with the metal terminal and when the pull rod is in a second position, the seizing piece releases the plug pin;

a toggle ring that is rotated by a user to drive the pull rod to slide between the first position and the second position; and, wherein a first portion of the seizing piece is within a supporting groove inside the power connector, while a second portion of the seizing piece is inserted into a driving groove of the pull rod, movement of the pull rod being controlled by the toggle ring;

wherein the toggle ring includes a tooth slot; and wherein the power connector additionally includes an elastic piece slightly locked in the tooth slot so as to increase rotational force required to rotate the toggle ring.

* * * * *